US009272295B2

(12) United States Patent
Esche et al.

(10) Patent No.: US 9,272,295 B2
(45) Date of Patent: Mar. 1, 2016

(54) SPRAYER ASSEMBLY

(75) Inventors: John C. Esche, Kohler, WI (US); William R. Bares, Fredonia, WI (US)

(73) Assignee: KOHLER CO., Kohler, WI (US)

( * ) Notice: Subject to any disclaimer, the term of this patent is extended or adjusted under 35 U.S.C. 154(b) by 867 days.

(21) Appl. No.: 12/368,068

(22) Filed: Feb. 9, 2009

(65) Prior Publication Data

US 2009/0200401 A1 Aug. 13, 2009

Related U.S. Application Data

(60) Provisional application No. 61/028,075, filed on Feb. 12, 2008.

(51) Int. Cl.

| | |
|---|---|
| ***B05B 1/16*** | (2006.01) |
| ***B05B 1/18*** | (2006.01) |
| ***B05B 12/00*** | (2006.01) |
| ***E03C 1/04*** | (2006.01) |

(52) U.S. Cl.

CPC ..... *B05B 1/1618* (2013.01); *B05B 1/16* (2013.01); *E03C 1/0409* (2013.01); *B05B 1/18* (2013.01); *B05B 12/002* (2013.01)

(58) Field of Classification Search

CPC ..... B05B 1/16; B05B 1/1618; B05B 1/18; B05B 12/002; E03C 1/0409

USPC ..... 239/436, 441, 443, 444, 445, 446, 448, 239/449, 525, 526, 548; 4/675, 678

See application file for complete search history.

(56) References Cited

U.S. PATENT DOCUMENTS

| | | | | |
|---|---|---|---|---|
| 4,204,646 | A | 5/1980 | Shames et al. | |
| 5,145,114 | A | 9/1992 | Monch | |
| 5,158,234 | A | 10/1992 | Magnenat et al. | |
| 5,383,604 | A | 1/1995 | Boesch | |
| 5,575,424 | A | 11/1996 | Fleischmann | |
| 5,690,312 | A | 11/1997 | Yang | |
| 5,707,011 | A | 1/1998 | Bosio | |
| 5,806,771 | A | 9/1998 | Loschelder et al. | |
| 5,937,905 | A | 8/1999 | Santos | |
| 6,045,062 | A | 4/2000 | Bosio | |
| 6,145,757 | A | 11/2000 | Knapp | |
| 6,151,729 | A * | 11/2000 | Yean | 4/675 |
| 6,296,011 | B1 | 10/2001 | Esche et al. | |
| 6,370,713 | B2 * | 4/2002 | Bosio | 4/677 |
| 6,568,605 | B1 | 5/2003 | Chen | |
| 6,691,933 | B1 | 2/2004 | Bosio | |
| 6,738,996 | B1 * | 5/2004 | Malek et al. | 4/677 |
| 6,935,375 | B2 | 8/2005 | Blessing | |

(Continued)

FOREIGN PATENT DOCUMENTS

EP 1418007 5/2004

OTHER PUBLICATIONS

PCT International Search Report. PCT/US2009/000895, filed Dec. 2, 2009.

*Primary Examiner* — Ryan Reis
(74) *Attorney, Agent, or Firm* — Foley & Lardner LLP

(57) ABSTRACT

The present invention provides a sprayer that has on the sprayer itself capability for simultaneously controlling on/off function and flow selection. A forward button can be pressed by a forefinger to turn flow on, while a rearward rocker can be controlled by a thumb to select between aerated and non-aerated flow. The on/off control is biased to the off position.

20 Claims, 6 Drawing Sheets

(56) References Cited

U.S. PATENT DOCUMENTS

| | | | | |
|---|---|---|---|---|
| 6,938,837 | B2 | 9/2005 | Nelson et al. | |
| 7,000,854 | B2 | 2/2006 | Malek et al. | |
| 7,070,125 | B2 | 7/2006 | Williams et al. | |
| 7,104,473 | B2 | 9/2006 | Bosio | |
| 2005/0103896 | A1* | 5/2005 | Bosio | 239/446 |
| 2005/0103905 | A1 | 5/2005 | Bosio | |
| 2005/0189438 | A1 | 9/2005 | Bosio | |
| 2006/0016912 | A1 | 1/2006 | Nobili | |
| 2007/0193640 | A1 | 8/2007 | Malek | |
| 2007/0194148 | A1 | 8/2007 | Rosko et al. | |
| 2007/0221757 | A1 | 9/2007 | Malek et al. | |
| 2008/0067264 | A1* | 3/2008 | Erickson et al. | 239/445 |

* cited by examiner

SPRAYER ASSEMBLY

CROSS-REFERENCE TO RELATED APPLICATION

This application claims priority based on U.S. provisional patent application Ser. No. 61/028,075 filed Feb. 12, 2008. The entire contents of that application are incorporated herein by reference.

STATEMENT OF FEDERALLY SPONSORED RESEARCH OR DEVELOPMENT

Not applicable.

BACKGROUND OF THE INVENTION

The present invention relates to sprayers useful in connection with faucets. More particularly it relates to sprayers having an on/off control and also a separate selector that can select between two different types of flow.

Sprayers are often used in connection with devices such as kitchen faucets. Some of these devices are mounted as a pull-out sprayer on the faucet itself. See e.g. U.S. Pat. Nos. 5,575,424 and 6,738,996.

Other sprayers, known as "side sprays", are mounted separately from the faucet upper housing along a counter top, sink or the like, with a supply hose that ultimately links to the same mixing valve that supplies the faucet. The supply hose is usually a retractable and flexible hose that extends under the counter top.

When pulled out from its rest seat such a side spray is typically activated by a lever or other activator at the spray head, to permit water to flow to the sprayer. This causes a diverter to simultaneously cut off flow through the faucet's outlet spout. Such a side sprayer is often used to emit a spray for closely rinsing utensils or dishes in a sink, or rinsing particular portions of a human in a bathtub or the like. Side sprays achieve this without requiring the visible aesthetics of the faucet housing to be disrupted.

There have been a variety of attempts to provide varied flow options and controls activatable at spray heads themselves. See e.g. U.S. Pat. Nos. 5,145,114, 5,158,234, 5,383,604, 5,575,424, 5,690,312, 5,707,011, 5,797,011, 5,806,771, 5,937,905, 6,045,062, 6,145,757, 6,151,729, 6,296,011, 6,370,713, 6,691,933, 6,738,996, 6,935,375, 6,938,835, 7,000,854, 7,070,125, and 7,104,473. See also U.S. patent application publications 2005/0103895, 2005/0103896, 2005/0189438 and 2006/0016912.

Some such spray heads only provide control at the spray head between two types of flow (but not also volume control as volume control is left to the main faucet valve). It can be awkward for a consumer to be controlling both volume and type of flow at distinctly separately places. Other such spray heads only control on/off at the spray head, and provide no flexibility in spray type.

Still other such spray heads both provide on/off control and flow selection at the spray head. However, they do so in a non-intuitive manner, or require awkward hand manipulations to achieve such control, or default the flow to the on position (as they are intended to provide a pause function).

Accordingly, there is a need for improved sprayers having both on/off control and flow selection at the spray head itself.

SUMMARY OF THE INVENTION

The present invention provides sprayers having a sprayer body having a handle portion and an outlet head, with a passage extending through the sprayer body from the handle portion through the outlet head. There is a flow selector valve positioned within the outlet head to direct flow between two exit pathways. There is also a first actuator positioned on an exterior portion of the outlet head to control the flow selector valve. The assembly also has an on/off valve positioned in the handle portion to control flow from the handle to the outlet head, and a second actuator positioned on an exterior frontal portion of the handle portion to control the on/off valve.

In preferred forms the first actuator is positioned on an exterior rear portion of the outlet head, the second actuator is biased to a position that directs the on/off valve to a closed position, and the second actuator is linked to a spool valve. The spool valve forms a portion of the on/off valve, and has an o-ring mounted on its periphery (that seats against an internal valve seat in the handle).

In other preferred forms the second actuator is a button and the first actuator is a rocker, the first and second actuators are located on opposed sides of the sprayer body, the first exit pathway extends to a set of nozzles providing a aerated flow pathway, and the second exit pathway extends to a non-aerated flow pathway. Other possible refinements include the sprayer body presenting an essentially L-shaped side view, and the sprayer being a side spray suitable to be linked to water flow permitted from a mixing valve of a faucet.

Of course, this type of sprayer could also be used as a pull-out type spray for a faucet, or even could be used as a form of personal shower head or bath spray.

The present invention thus provides a sprayer that can easily provide on/off control and spray selection using a single hand. Most preferably the design permits a thumb to control a rocker for selecting between spray types at the same time a forefinger can control the on/off function. The device is intuitive, relatively inexpensive to manufacture, reliable, and easy to maintain.

These and still other advantages of the invention will be apparent from the detailed description and drawings. What follows is merely a description of one preferred embodiment of the present invention. To assess the full scope of the invention the claims should be looked to as this preferred embodiment is not intended to be the only embodiment within the scope of the claims.

DETAILED DESCRIPTION OF THE PREFERRED EMBODIMENT

Figure 1:
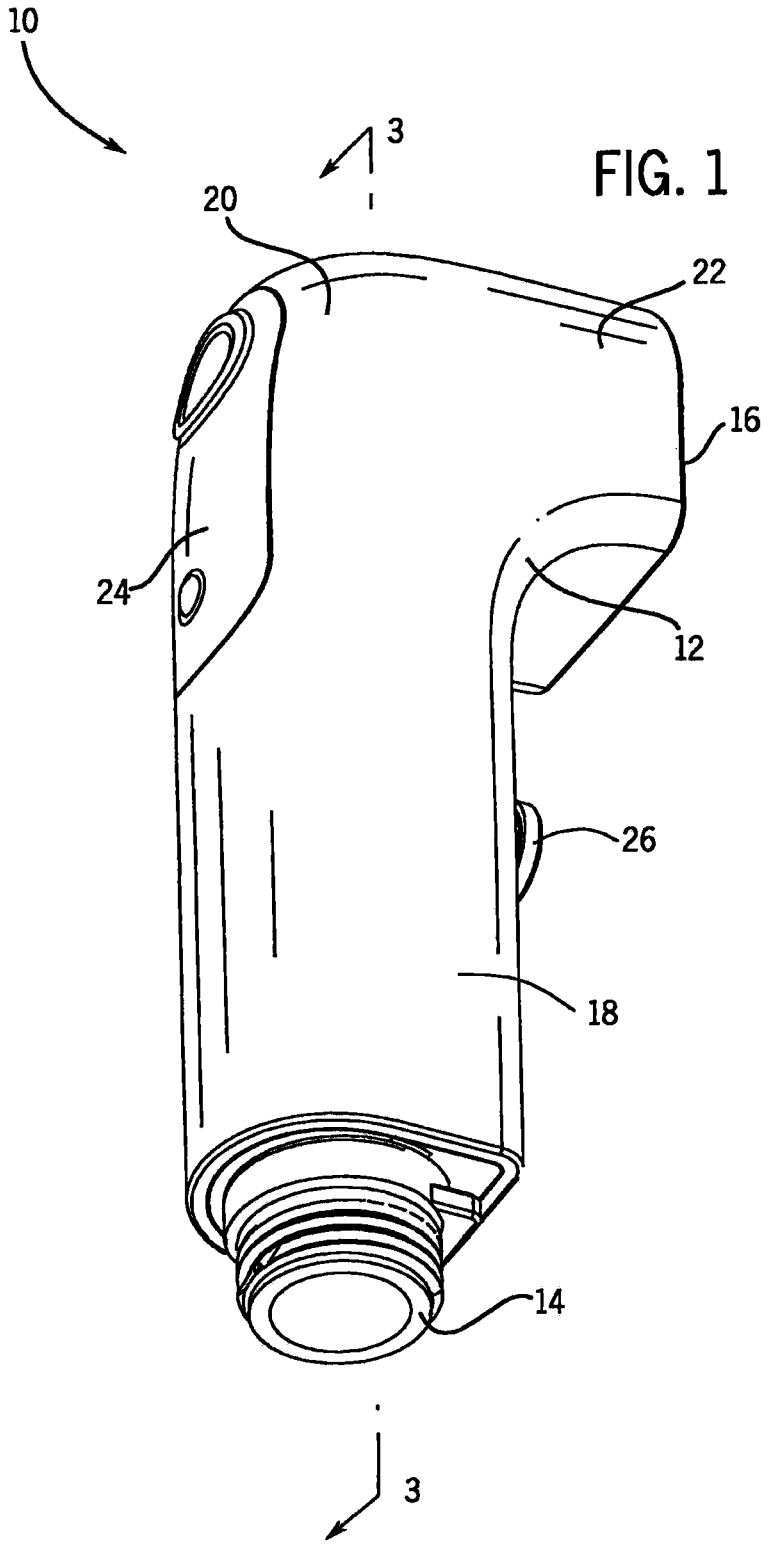
FIG. 1 is a lower rear perspective view of an embodiment of the present invention.
Figure 2:
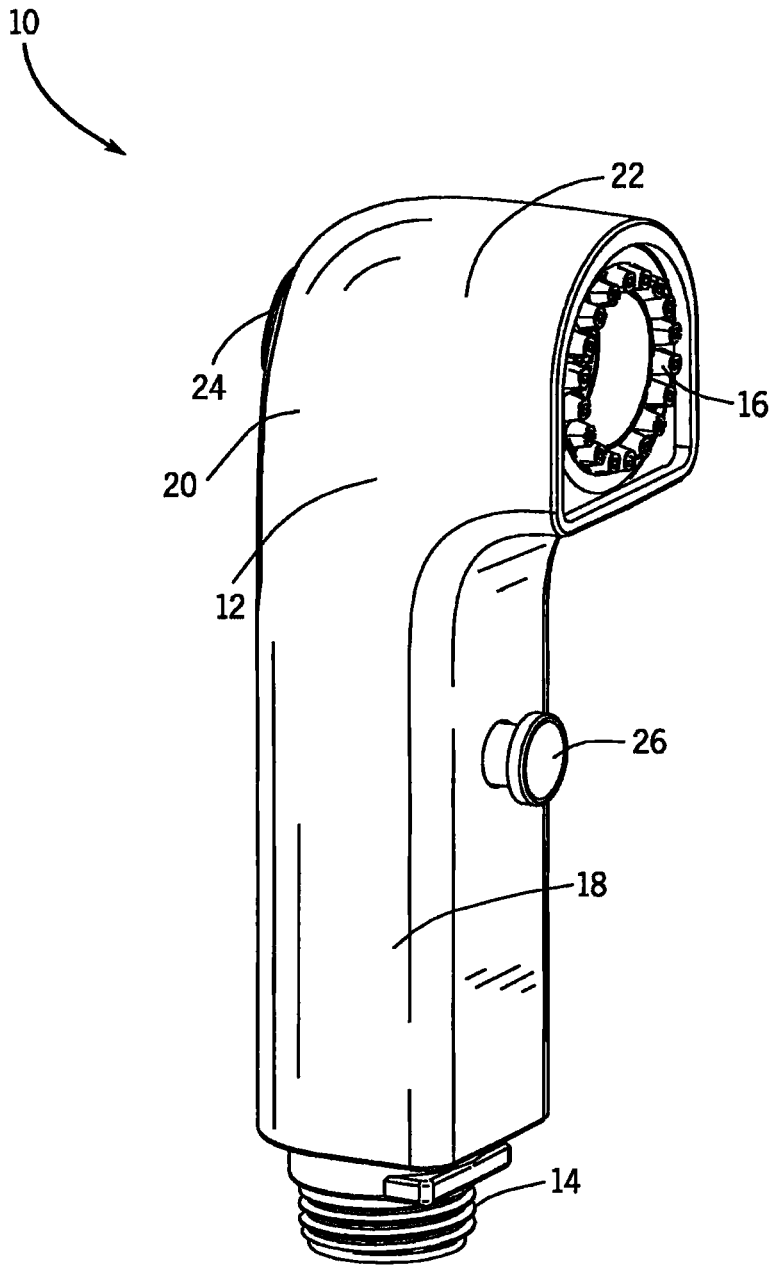
FIG. 2 is a frontal side perspective view thereof.

A sprayer 10 has a sprayer body 12. A lower end of the body in the form of a handle 18 has formed thereon a hose connector 14. This is suitable to link in the usual fashion to a water supply hose 21 (see FIG. 3).

The sprayer body 12 also has an outlet head 16. Hence, this creates an essentially L-shaped appearance in side view with a long leg portion of the handle 18, a bend 20 beginning the outlet head 16, and a short leg 22 portion which is also part of the outlet head.

On the rear side of the sprayer body 12, there is positioned a first actuator in the form of a toggle rocker button 24. The toggle rocker button 24 can be used to change the spray pattern that flows from the outlet head 16 between an aerated flow and a non-aerated flow.

On the frontal side of the sprayer body 12, near the neck of the sprayer body, is a second actuator in the form of an on/off control button 26. The button 26 is biased radially outward/forwardly, such that while it may be depressed against spring pressure, it will spring back out/forwardly automatically when released.

Figure 5:
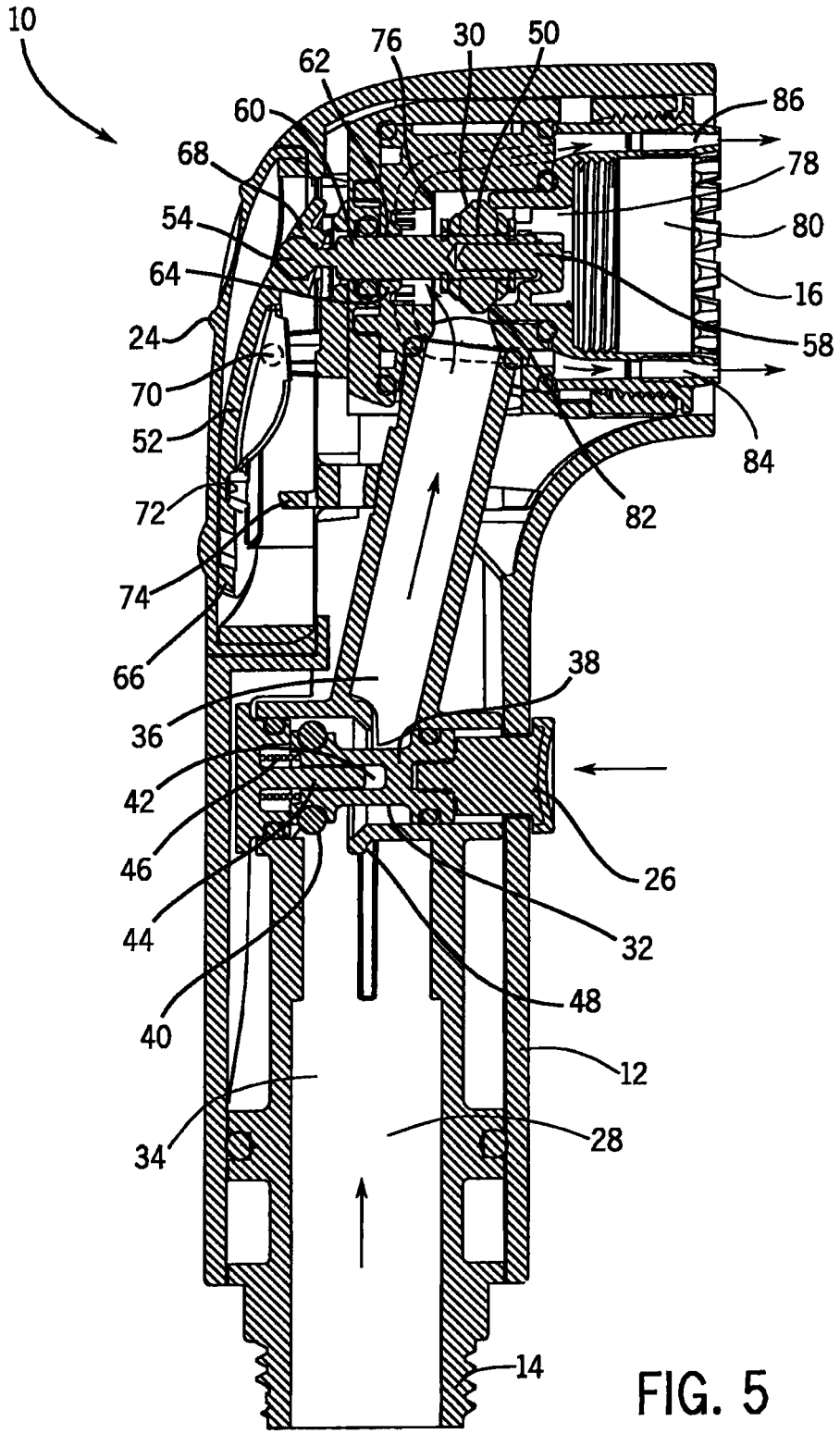
FIG. 5 is a view similar to FIG. 4, but with the on/off button in the on position.
Figure 6:
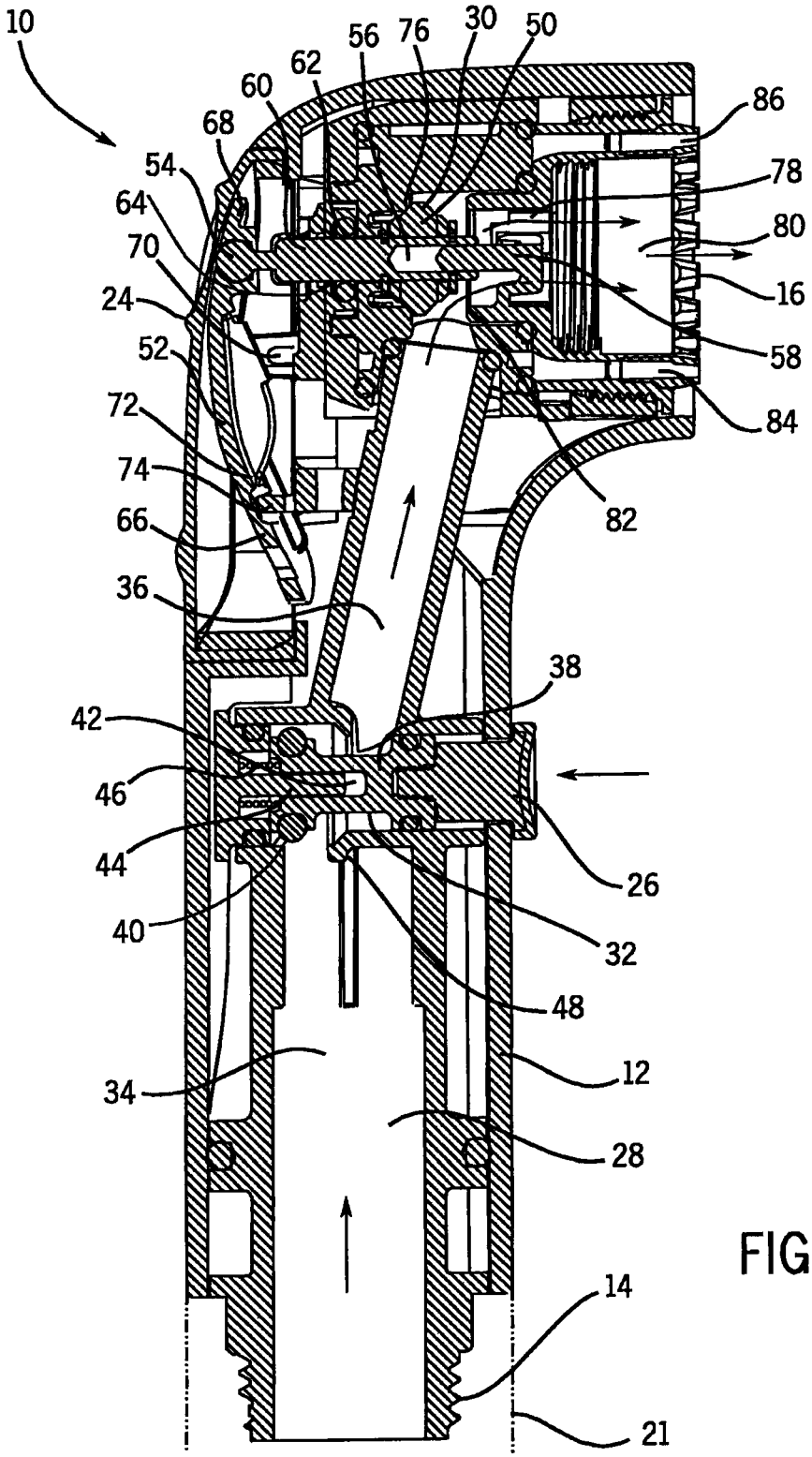
FIG. 6 is a view similar to FIG. 3, but with the on/off button in the on position.

As will be appreciated from FIG. 5 or 6, when the button 26 is depressed rearwardly water can flow through the sprayer 10 and out of the outlet head 16. The spray pattern emanating from the outlet head 16 can be toggled between a regular flow pattern and an aerated flow pattern using the toggle rocker button 24. When the button 26 is released, then the outlet head 16 stops spraying water.

Referring now more specifically to FIGS. 3, 4, 5, and 6 cross-sectional views of the interior of the sprayer 10 are shown. A central passage 28 extends from the hose connector 14 to the spray selection valve 30, and ultimately via exit pathways out the front of the spray head. The central passage 28 is divided by the on/off valve 32 into an upstream side 34 and a downstream side 36.

The valve 32 is connected to the button 26. It includes a spool 38 having an o-ring 40 attached and a cavity 42. The cavity 42 engages a guiding post 44 to guide the spool 38. A spring 46 is located around the post 44 and engages a surface of the spool 38 to bias the spool 38 down.

In the closed position (FIGS. 3 and 4), the o-ring 40 forms a seal with a valve seat 48. This seal blocks the flow of water from the upstream side 34 to the downstream side 36 of the central passage 28.

When the button 26 is depressed, the seal is broken as the spool 38 is moved upward. This permits water to flow past the valve 32.

A spray selection valve 30 is in communication with the downstream side 36 of the central passage 28. A variety of known selectors could be used at this point. See e.g. the selector assembly of U.S. Pat. Nos. 5,707,011 and 6,045,062, the disclosure of which is incorporated by reference.

By way of example, the spray selection valve 30 could include a sliding portion 50 that is connected to a toggle rocker 52 at a ball and socket joint 54. The sliding portion 50 has a cavity 56 that engages a tab 58 and a straight portion 60 that is captured by side walls 62 and 64 and thus linearly restricting the movement of the sliding portion 50.

Figure 3:
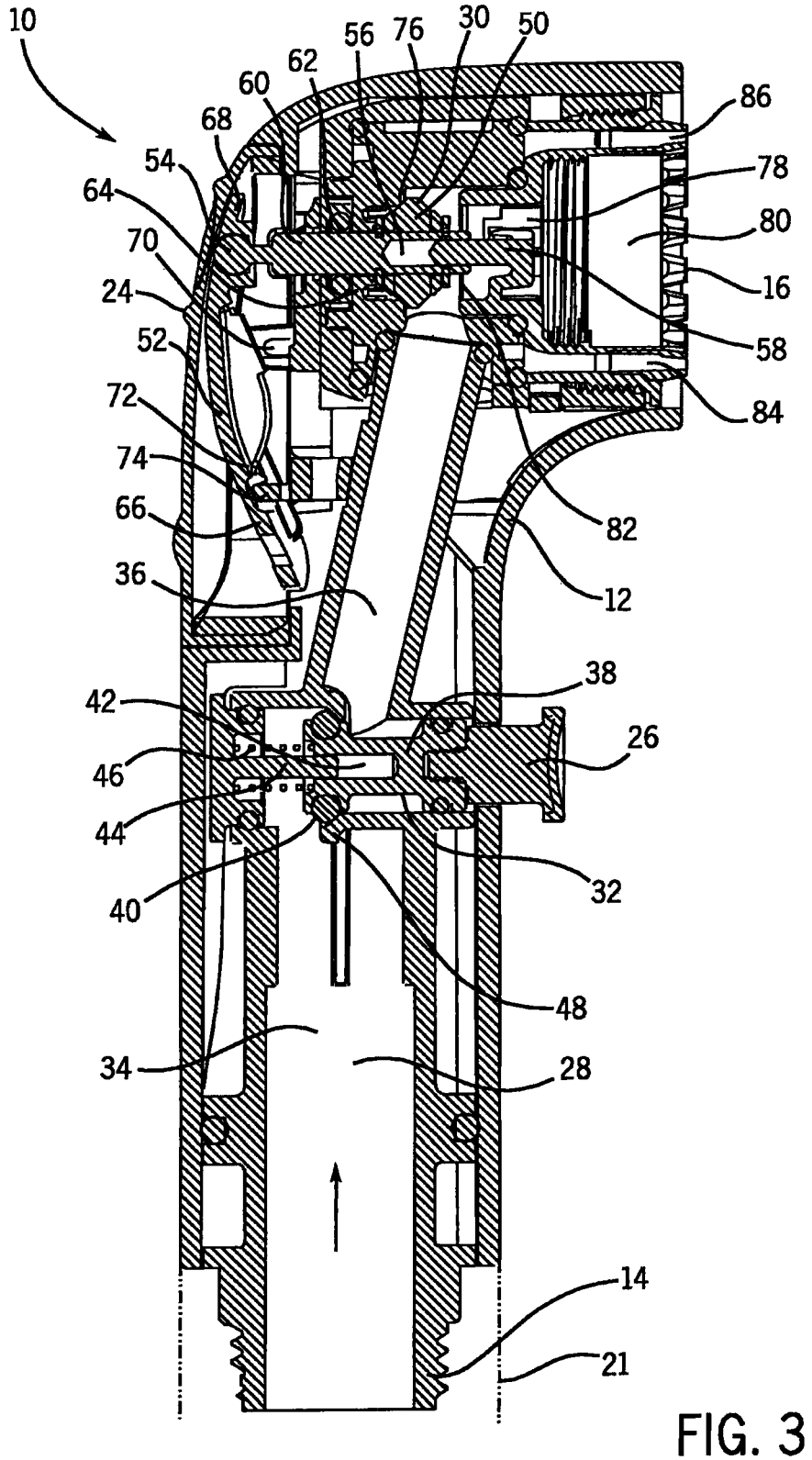
FIG. 3 is a sectional view taken along line 3-3 of FIG. 1, depicting the sprayer with the toggle rocker placed in the aerator selection position, and the on/off button in the "rest" closed position.

The toggle rocker 52 has an unconnected end 66 that is not connected to anything and a connected end 68 that connects to the ball and socket joint 54. Between the unconnected end 66 and connected end 68 is a pivot joint 70. The unconnected end 66 can be depressed to a point at which a recess 72 in the unconnected end 66 engages a stop 74 as shown in FIGS. 3 and 6. When the unconnected end 66 is depressed, the connected end 68 is elevated such that the ball and socket joint 54 lifts the sliding portion 50 of the spray selection valve 30 to seal the walls 76 and direct any water entering the spray selection valve 30 down a first exit 78 to an aerator 80 to provide an aerated spray pattern out of outlet head 16.

Figure 4:
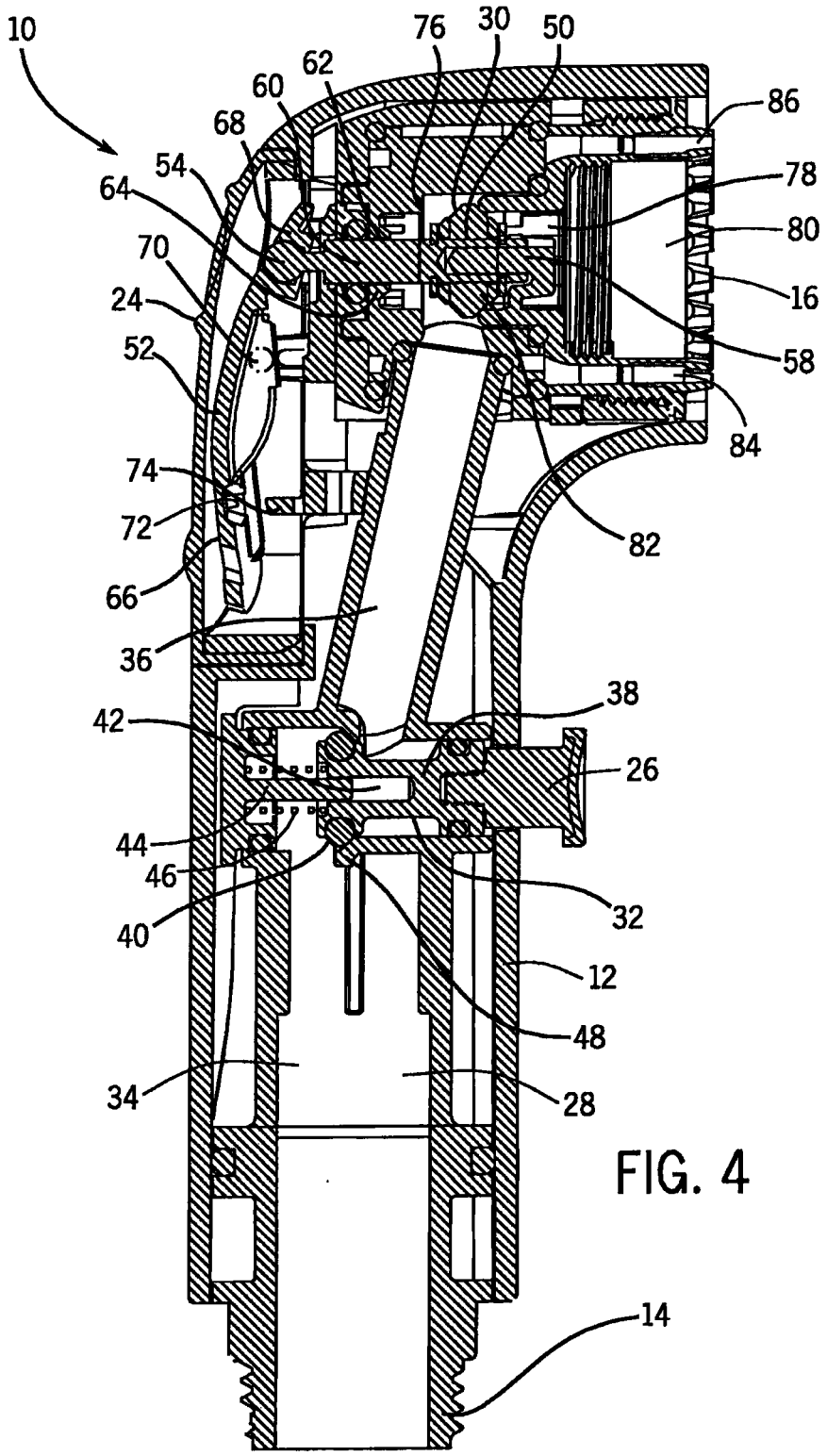
FIG. 4 is a view similar to FIG. 3, but with the toggle rocker placed in the non-aerated flow selection position.

The connected end 68 of the toggle rocker 52 may be depressed, as shown in FIGS. 4 and 5, to force the sliding portion 50 of the spray selection valve 30 down to seal walls 82. By sealing the walls 82, communication between the central passage 28 and the first exit 78 is blocked, but communication between the central passage 28 and a second exit 84 and the nozzles 86 is created (a portion of the second exit 84 is shown in phantom lines in FIG. 5). When in operation, the nozzles 86 provide a regular spray pattern out of the outlet head 16.

Because the toggle rocker 52 is able to pivot between the two locations, when one of the unconnected end 66 and the connected end 68 is depressed, the other is moved in an upward position. By depressing the end in the upward position, the toggle rocker 52 will move the spray selection valve 30 to the other position. Thus the toggle rocker 52 controls the spray selection valve 30 to place the central passage 28 in selective communication with one of the first exit 78 and the second exit 84, each of which feed to the outlet head 16 to provide a different spray pattern from the other.

In operation a water supply hose 21 is connected to the hose connector 14 to supply a flow of water from a mixing valve of a nearby faucet or the like (not shown). Unless the button 26 is depressed, no flow will pass through the sprayer. When it is depressed flow will start. Depending on which exit passage is selected, the flow will either be aerated or non-aerated.

Note in particular that adjustments in on/off and type of flow can be made simultaneously and conveniently with a single hand. A forefinger can depress the button 26 to start the spray, while a thumb can operate the toggle rocker 52 to change the spray pattern. The forces offset each other as they are in opposed directions, and the operation is highly intuitive.

It should be appreciated that a preferred embodiment of the invention has been described above. However, many modifications and variations to this preferred embodiment will be apparent to those skilled in the art, which will be within the spirit and scope of the invention. For example, the button 26 could be a cammed slider or other form of actuator. Therefore, the invention should not be limited to the described embodiment. To ascertain the full scope of the invention, the following claims should be referenced.

INDUSTRIAL APPLICABILITY

The invention provides an improved sprayer having the capability to itself simultaneously control on/off and flow selection.

We claim:

1. A sprayer, comprising:

a sprayer body having a handle portion and an outlet head, with a passage extending through the sprayer body from the handle portion through the outlet head;

a flow selector valve positioned within the outlet head to direct flow between two exit pathways;

a first actuator positioned on an exterior rear side of the outlet head to control the flow selector valve;

an on/off valve positioned in the handle portion to control flow from the handle to the outlet head; and a second actuator positioned on an exterior frontal side of the handle portion to control the on/off valve;

wherein the first and second actuators are located on opposing frontal and rear sides of the sprayer body to allow the first actuator to be pressed by a thumb while the second actuator is simultaneously contacted by another finger on the same hand as the thumb while said same hand is grasping the handle portion; and wherein the second actuator is biased to a position that directs the on/off valve to a closed position.

2. The sprayer of claim 1, wherein the first actuator is positioned on an exterior rear portion of the outlet head.

3. The sprayer of claim 1, wherein the second actuator is linked to a spool valve, the spool valve forming a portion of the on/off valve.

4. The sprayer of claim 3, wherein the spool valve has an o-ring mounted on its periphery.

5. The sprayer of claim 1, wherein the second actuator is a button, and the first actuator is a rocker.

6. The sprayer of claim 1, wherein the first exit pathway extends to an aerator suitable to provide an aerated flow pattern and the second exit pathway extends to a set of nozzles providing a non-aerated flow pathway.

7. The sprayer of claim 1, wherein the sprayer body is generally L-shaped in side view.

8. The sprayer of claim 1, wherein the sprayer is a side spray suitable to be linked to water flow permitted from a mixing valve of a faucet.

9. The sprayer of claim 1, wherein the first and second actuators are positioned such that pressing the first actuator with a thumb can alter flow between the two exit pathways by driving a part of the flow selector valve forward while to some extent also offsetting a rearward force provided by contacting the second actuator with said finger while said finger is thereby holding the on/off valve on by forcing a part of the on/off valve rearward.

10. The sprayer of claim 1, wherein the first actuator located on the rear portion of the outlet head is configured such that the force applied to the first actuator opposes the force from the water exiting the outlet head.

11. The sprayer of claim 1, wherein the flow selector valve includes a sliding portion that is configured to move between first and second positions in a direction that is substantially parallel to a central axis defined by a first exit of the outlet head.

12. The sprayer of claim 11, wherein the on/off valve includes a spool that is configured to move between on and off positions along a second direction that is substantially parallel to the direction that the sliding portion is able to move along.

13. The sprayer of claim 11, wherein the sliding portion and the first exit are substantially concentric such that the force to activate the sliding portion directly opposes the force induced by the water exiting the first exit.

14. A sprayer, comprising:

a sprayer body having an outlet head and an axially elongated handle, the handle having a first end that receives a water supply and a second end that is in fluid communication with the outlet head, the outlet head being configured to direct fluid in a transverse direction relative to the handle;

a flow selector valve positioned within the outlet head to direct flow between two exit pathways;

a first actuator that is configured to control the flow selector valve;

an on/off valve positioned in the handle portion to control flow from the handle to the outlet head; and a second actuator to control the on/off valve;

wherein the first actuator is positioned on a rear side of the outlet head proximate the second end of the handle, and the second actuator is positioned on a frontal side of the handle between the first and second ends, the frontal side being radially opposite the rear side; and wherein the forces applied to the oppositely disposed first and second actuators at least partially offset each other when both-the first actuator and the second actuator are depressed.

15. The sprayer of claim 14, wherein the first and second actuators are positioned such that pressing the first actuator with a thumb can alter flow between the two exit pathways by driving a part of the flow selector valve forward while to some extent also offsetting a rearward force provided by depressing the second actuator with the other finger while said finger is thereby holding the on/off valve on by forcing a part of the on/off valve rearward.

16. The sprayer of claim 14, wherein the second actuator is linked to a spool valve, the spool valve forming a portion of the on/off valve.

17. The sprayer of claim 14, wherein the spool valve has an o-ring mounted on its periphery, the o-ring configured to form a seal with a valve seat when the valve is in a closed position.

18. The sprayer of claim 17, wherein the spool also includes a cavity that engages a guiding post to guide the spool when the spool moves between open and closed positions.

19. The sprayer of claim 14, wherein the second actuator is biased to a position that directs the on/off valve to a closed position.

20. A sprayer, comprising:

a sprayer body having an outlet head and an axially elongated handle, the handle having a first end that receives a water supply and a second end that is in fluid communication with the outlet head, the outlet head being configured to direct fluid in a transverse direction relative to the handle;

a flow selector valve positioned within the outlet head and configured to direct flow between two exit pathways;

a first actuator positioned on a rear side of the outlet head and configured to control the flow selector valve;

an on/off valve positioned in the handle portion and configured to control flow from the handle to the outlet head; and a second actuator positioned on a frontal side of the handle, the frontal side radially opposite the rear side, and configured to control the on/off valve, the second actuator biased to a position that directs the on/off valve to a closed position.

* * * * *